US005199113A

United States Patent [19]

Glasow et al.

[11] Patent Number: 5,199,113

[45] Date of Patent: Apr. 6, 1993

[54] AUTOMATICALLY ADJUSTED WATER CLOSET FOR HANDICAPPED AND OTHER FAMILY MEMBERS

[76] Inventors: George L. Glasow; Pilar Vilar-Glasow, both of 31 Scottsville Rd., Rochester, N.Y. 14611

[21] Appl. No.: 803,037

[22] Filed: Dec. 6, 1991

[51] Int. Cl.[5] ..... E03D 11/00

[52] U.S. Cl. ..... 4/252.2; 4/564.1; 192/129 R

[58] Field of Search ..... 4/252.1, 252.2, 252.3, 4/254, 420, 560.1-566.1; 192/129 A, 129 R, 141; 74/89.15; 297/DIG. 10

[56] References Cited

U.S. PATENT DOCUMENTS

| | | | |
|---|---|---|---|
| 2,880,155 | 3/1959 | Lichtenberger et al. | 192/129 R |
| 3,605,134 | 9/1971 | Haering | 4/252.2 |
| 4,091,473 | 5/1978 | Matthews et al. | 4/420 |
| 4,174,546 | 11/1979 | Ohtake | 4/252.1 X |
| 4,441,218 | 4/1984 | Trybom | 4/252.1 X |

FOREIGN PATENT DOCUMENTS

| | | | |
|---|---|---|---|
| 8103040 | 10/1981 | World Int. Prop. O. | 4/252.3 |

*Primary Examiner*—Henry J. Recla
*Assistant Examiner*—Robert M. Fetsuga

[57] ABSTRACT

A toilet elevation adjusting apparatus having an inner box-shaped frame secured within an outer box-shaped frame by channels and wheels to allow vertical displacement of the inner frame while the outer frame is secured to a wall. A toilet is secured to the inner frame to translate with it. A drive mechanism for displacing the inner frame includes a reversible motor and a safety connection to the inner frame which allows lifting and lowering of the toilet under normal conditions, but disengages the motor from the inner frame when the toilet interferes with an object disposed under it during lowering to prevent exertion of force on the toilet from the motor. Three microswitches are also provided to control the motor operation.

6 Claims, 6 Drawing Sheets

AUTOMATICALLY ADJUSTED WATER CLOSET FOR HANDICAPPED AND OTHER FAMILY MEMBERS

REFERENCES CITED

| U.S. PATENT DOCUMENTS | | |
|---|---|---|
| 4,091,473 | Matthews et al | 4/420 |
| 4,777,671 | Kearns | 4/251 |
| 4,726,079 | Signori et al | 4/252 |
| 4,174,546 | Ohtake | 4/420 |
| 4,168,552 | Austin | 4/237 |
| 3,925,833 | Hunter | 4/251 |
| 3,914,806 | Pearce | 4/254 |

BACKGROUND

1. Field of Invention

This invention relates to water-closets, specifically to an improved automatically adjustable water closet designed for families that need to adjust the height of a toilet to accommodate various family members. It is ideal for families that contain a handicapped or disabled member, as well as for use in public facilities in which the needs of various individuals using public restrooms need to be accommodated.

2. Discussion of Prior Art

New legislation will require that all multi-dwelling buildings are adequately equipped for the handicapped starting in 1991. Adjustable bathroom fixtures (sinks, bidets, urinals, baths, toilets) would make it easier for use by the handicapped and others with special needs (elderly, disabled, children, midgets, giants).

Heretofore, most adjustable water closets have consisted of various apparatus designed to raise and lower a false toilet seat above the level of a standard toilet and to lower it again (Hunter, U.S. Pat. No. 3,925,833; Austin, U.S. Pat. No. 4,168,552; Pearce, U.S. Pat. No. 3,914,806). From a commercial perspective these devices are relatively inexpensive. However, they contain generic safety and hygiene problems. Additionally, none of these devices adequately address the issue of stigma which the user may experience when using a device that makes it apparent to themselves and to others that they have a problem. None of these designs allow the toilet to be lowered to accommodate children or midgets.

In recent years, there has been a shift towards the design of adjustable water closets in which the toilet and accompanying plumbing is raised and lowered, thus reducing some of the safety, hygiene, and stigma concerns.

The Ohtake design (U.S. Pat. No. 4,174,546) allows the entire water closet to be raised and lowered to a level almost flush with the floor. This design has the benefit of being able to be used by individuals who need a toilet lowered and not only those who need it raised. Individuals benefitting from a lowered toilet would include children, individuals who prefer a Japanese style water closet, and midgets. Although Ohtake's design was an improvement over the previous art, it contained two basic design flaws: (1) There's a danger of the device tipping when in some positions, and (2) When in the lowered position it would occupy considerable space, reducing the amount of disposable living space below.

The Signori et al design (U.S. Pat. No. 4,726,079) uses yet another approach to raising and lowering the entire toilet bowl apparatus by using a system of bellows and hydraulic pressure. The device however, does not contain a pressure pump for increasing and maintaining pressure. It merely assumes that the natural flow of water from one chamber to another will be sufficient to generate the pressure required to lift both the apparatus and the person.

The Matthews et al design (U.S. Pat. No. 4,091,473) is the best to date in that it minimizes the use of space and stigma. However, some design flaws still make it implausible to use this design on a commercial basis.

The problems include:

(a) The support mechanism for the total load of person and product could easily be bent or broken and the device could collapse with continued use of heavy weight.

(b) The slots required for raising and lowering the toilet also pose a potential safety hazard by providing potential pinch points.

(c) The safety switch placed under the toilet to stop its movement in the event that someone becomes trapped under it, requires that someone come in direct contact with this point. This may not always be possible.

(d) Although hygiene problems are considerably decreased in this design, the use of flexible tubing in the waste line still poses a hygiene problem.

(e) Some commercial limitations are also posed by this design. Matthews limits has claims to adjustable toilets without a tank. In order to use these toilets within residential areas, one would be required to install a large commercial input line for flushing the required volume or make some other modifications such as adding a separate supply tank to the toilet. This would be an additional expense to the homeowner.

(f) Although the wall switch is an improvement in convenience, it does not provide the level of convenience to which people are becoming accustomed.

SUMMARY OF INVENTION

It is therefore the object of the present invention to provide bathroom fixtures, and specifically water closets that raise and lower at the push of a button to different heights adjusted for normal individuals as well as those with special needs (elderly, disabled, children, midgets, giants). Among the objects of the present invention are:

to provide new and useful bathroom fixtures for people with special needs, to provide new and useful bathroom fixtures without distinguishing characteristics which indicate that the fixtures are special, thus removing stigma, to provide new and useful bathroom fixtures which maintain high hygiene standards, to provide new and useful bathroom fixtures with various safety features included, to provide new and useful bathroom fixtures that are strong and provide maximum support, specifically with respect to an adjustable water closet, which must be able to support the weight of people of various weights, to provide new and useful bathroom fixtures that allow for easy conversion of conventional fixtures to provide new and useful bathroom fixtures that are trouble free and can easily be accepted by plumbers as the features would be in compliance with plumbing codes.

DETAILED DESCRIPTION OF THE SHOWN EMBODIMENTS

Figure 1:
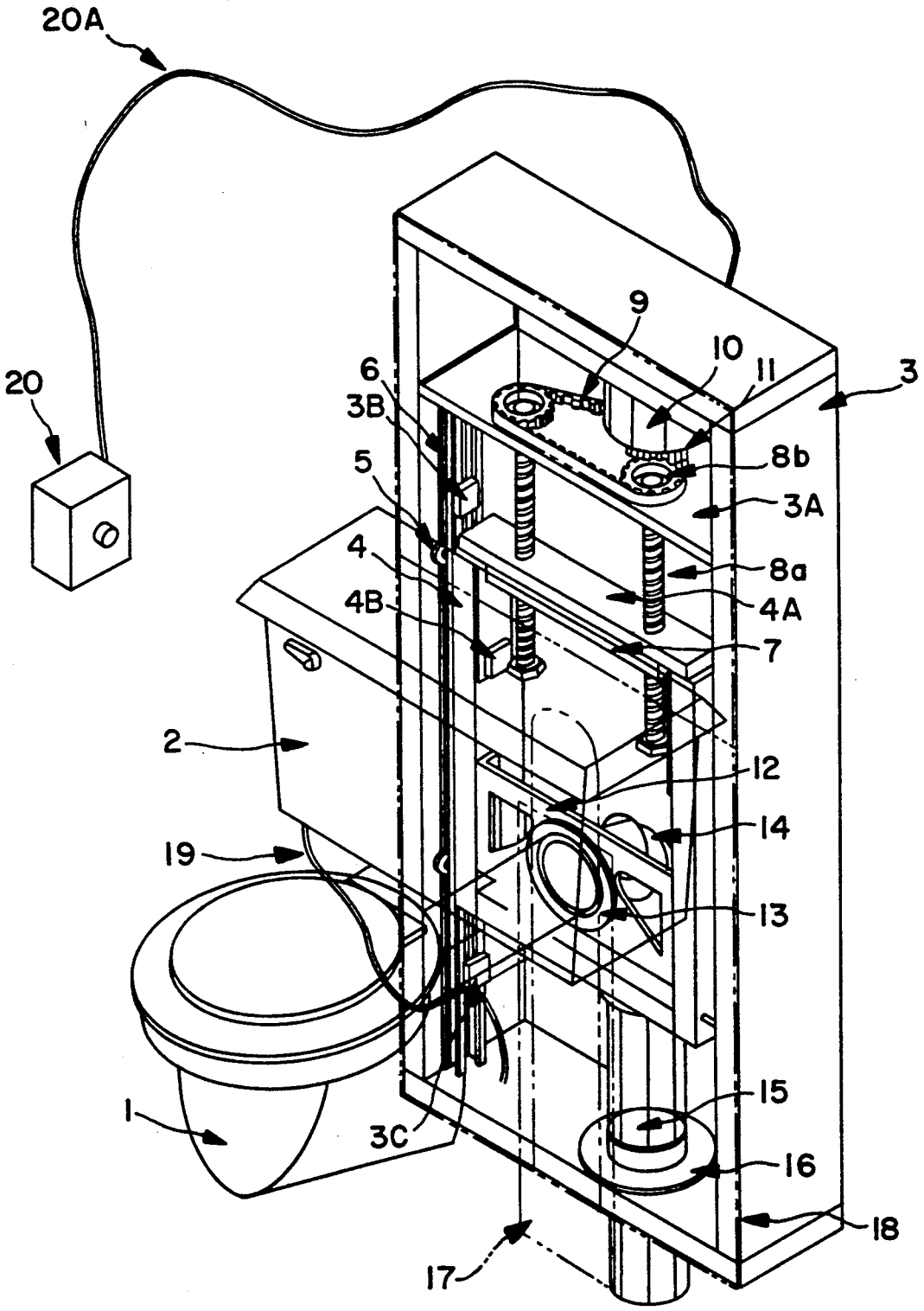
FIG. 1 shows the complete assembly of a bathroom fixture, and specifically of an automatically adjusted water closet with all parts indicated and labeled.
Figure 2:
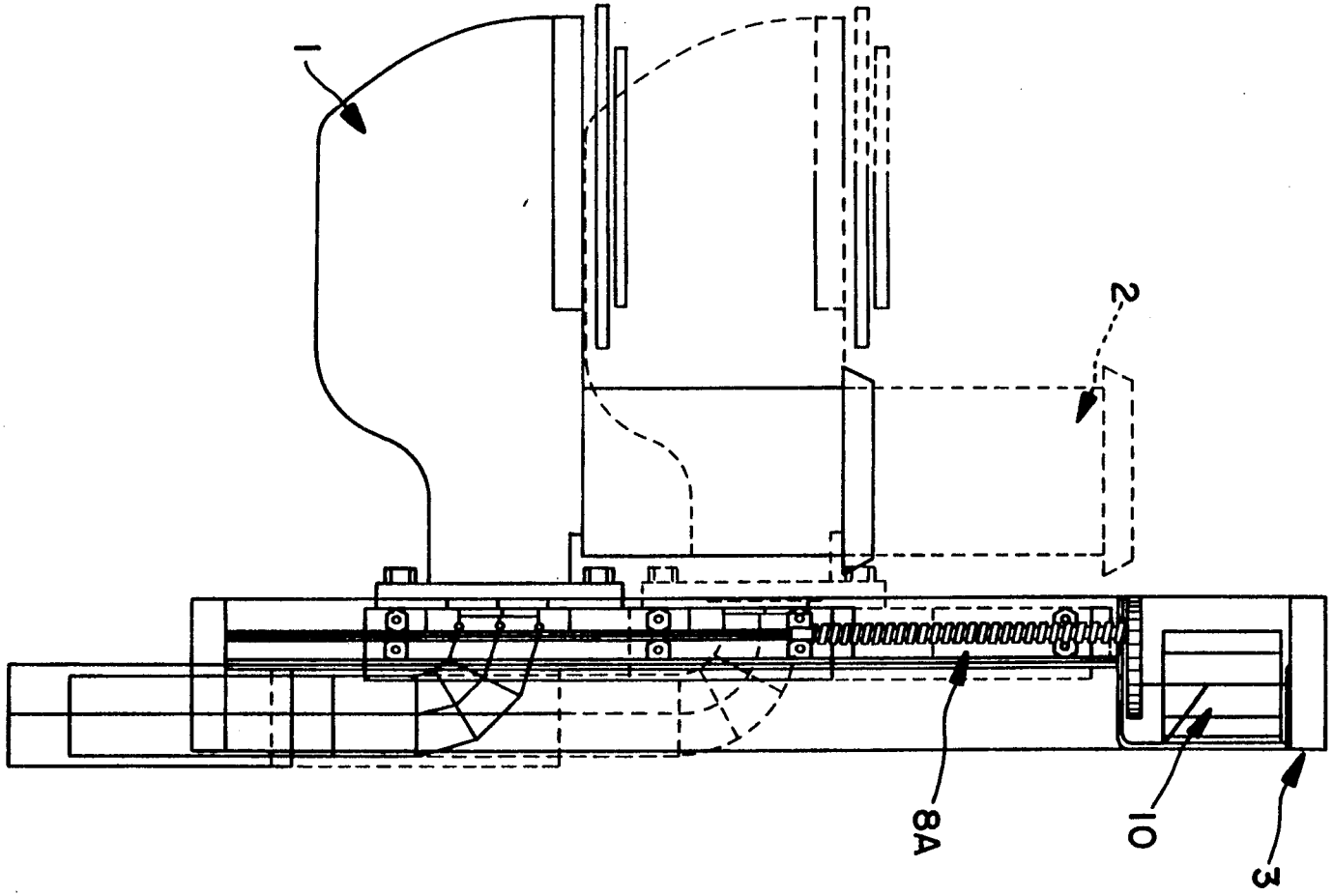
FIG. 2 is a lateral view showing the position of the motor, drive system, and waste drop.

FIG. 1 shows the complete assembly containing a standard wall hanging toilet (1) with a standard tank assembly (2), so that it can be installed in any residential or commercial property.

Figure 3B:
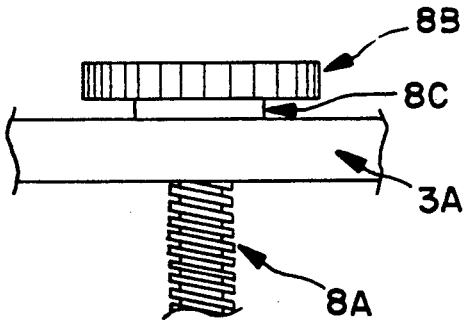
FIGS. 3*a* and 3*b* show the outer box assembly with timing gears, timing belt, screws, channels, limit switches, and the safety lifting block.
Figure 3A:
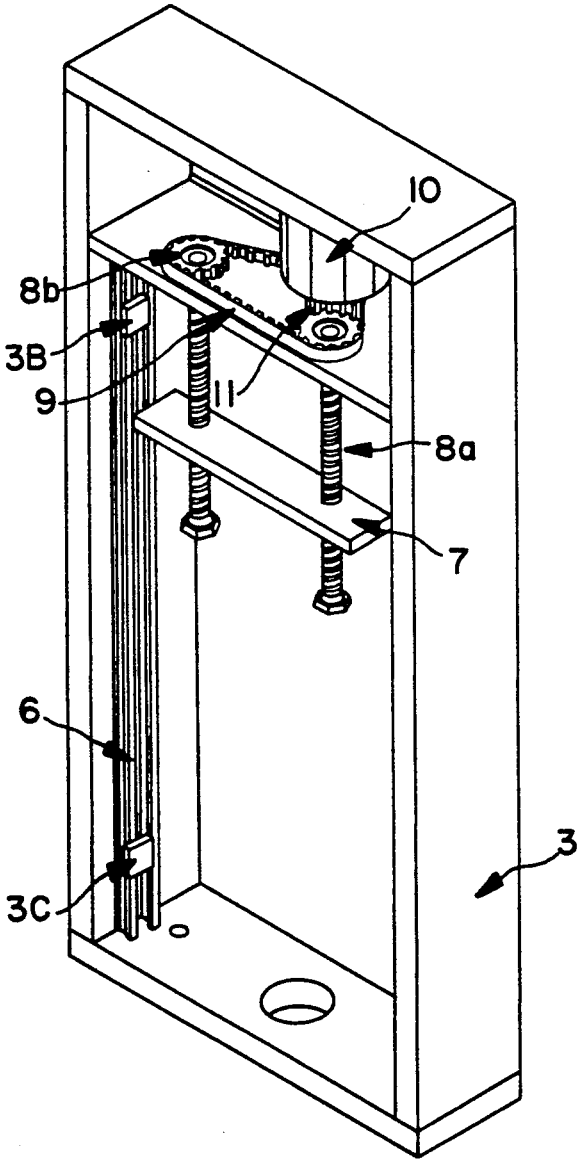

The main configuration controlling both vertical movement and support of a person of reasonable weight (up to 1,000 pounds) plus all other components is obtained within the outer box (3), also FIG. 3.

Figure 4:
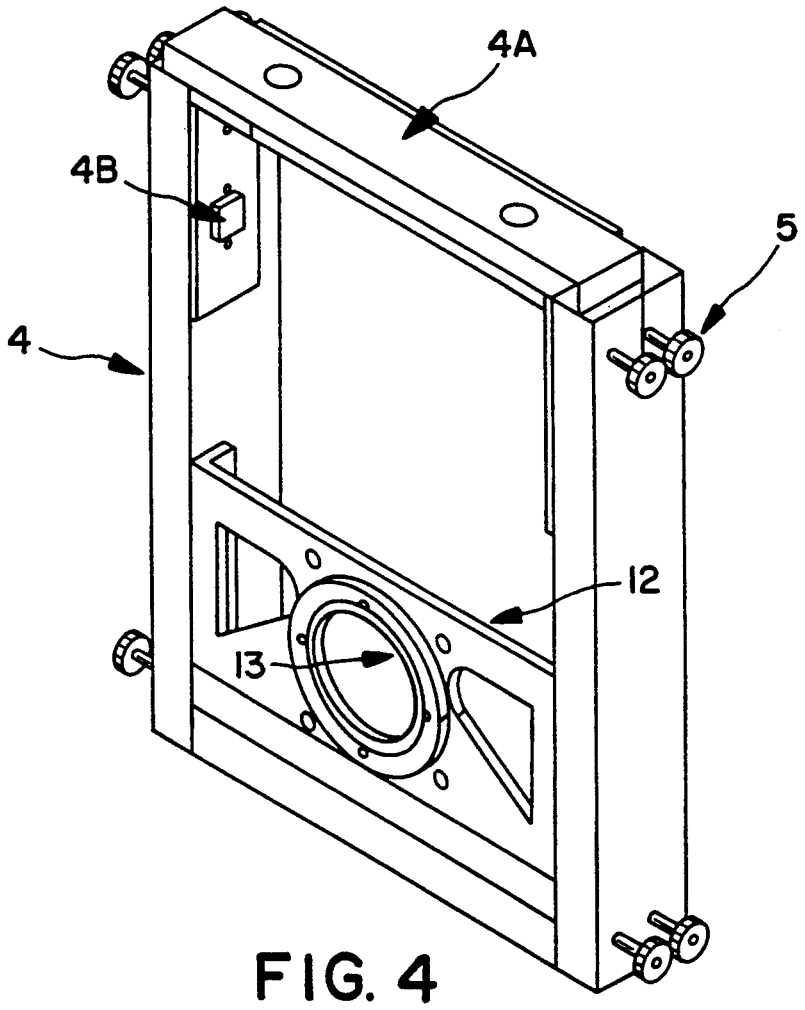
FIG. 4 shows the inner box assembly with wheels, standard carrier, and safety switches.

The inner box (4), and also FIG. 4 is allowed to move up and down, allowing sufficient freedom for a looped flexible supply line (19) to move at least 14 inches. This movement is controlled by wheels (5) within channels (6). The guides are in tandem, side by side, so that the load can be carried by the channels (6) serving as load conveyors. Side and vertical thrust is thus minimized and the possibility of bending the channel is reduced.

A safety lifting block (7) floats within the inner box (4). When the motor is in the lifting direction, it will pull up the lifting block (7) to the top of the upper frame of the inner box (4) until it kisses the upper cross member (4A) of the inner box, thereby raising the toilet. When the motor (10) is told to send the toilet down, and if there's interference in the travel of the toilet, the toilet will stop and the safety lifting block (7) will break away until it reaches a downward microswitch (4B), that shuts sown the power in the downward direction, thus, making it safe. In this manner, there is no possibility that the downward pressure of the motor could damage someone who might be trapped under the toilet. A second downward microswitch (3C) is placed in the outer box for normal use (See FIG. 3).

The inner box (4) is connected to the outer box (3) (See FIG. 3) by two screws (8A) hanging from the support plate (3A). The screws are driven by timing gears (8B) which are fixed solid to the screws (8A) and encircled by a timing belt (9) driven by the motor (10) and drive gear (11). Vertical thrust bearings (8C) are placed between the timing gear (8B) and the plate (3A) to reduce friction between timing gear (8B) and plate (3A).

Figure 5:
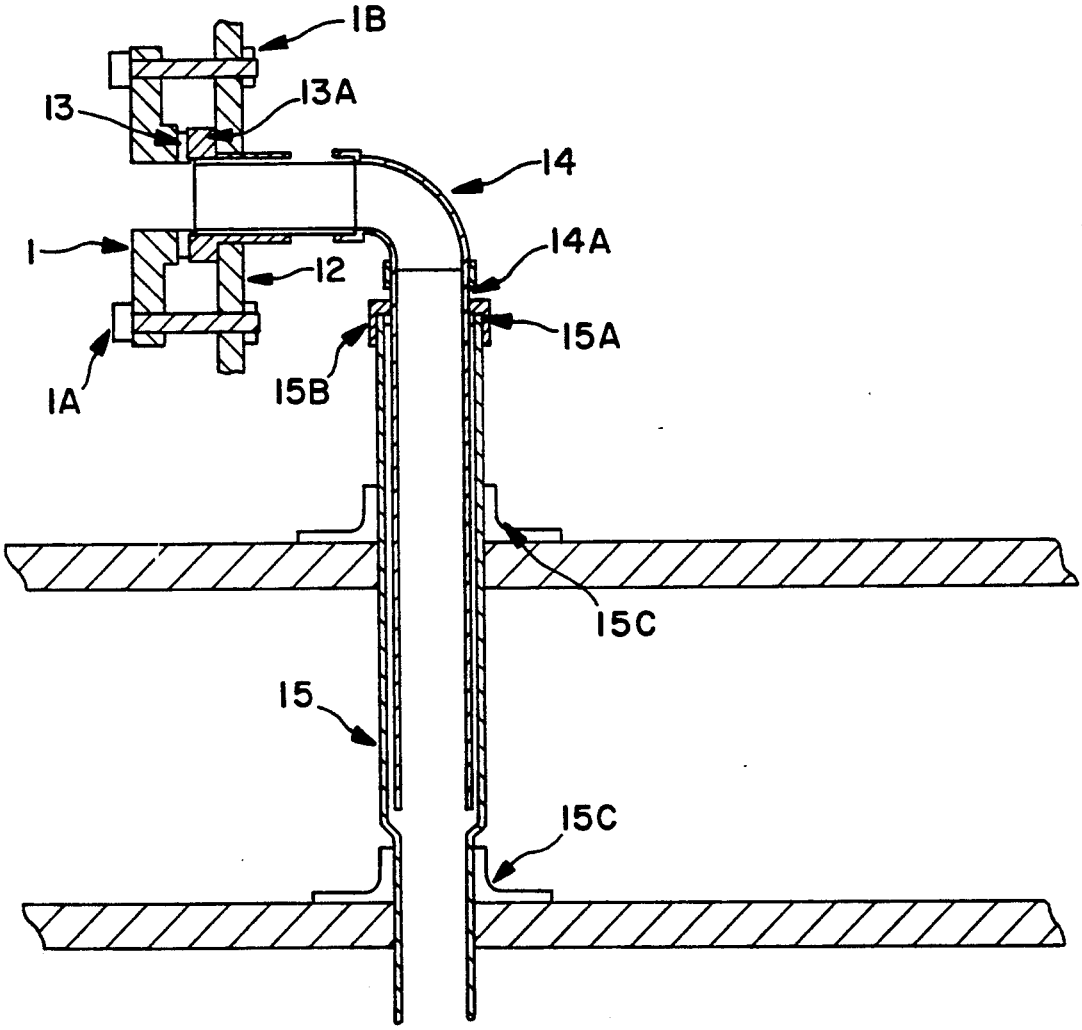
FIG. 5 is a sectional view, showing the slip joint assembly being held by two support systems.

The toilet (1) is mounted to a standard wall hung carrier (12) which is connected to the sides of the inner box (4) (See FIG. 4). FIG. 5 is a sectional view showing the toilet flange, part of a standard toilet (1) held to the carrier by 4 studs (1A) with nuts (1B) of standard spacing for wall hung toilets, crushing the wax ring into the pvc flange (13A).

Within the opening of the carrier (12) (SEE FIG. 5) is a standard wax ring (13) which mounts between the toilet and the pvc flange (13A) connected to the three inch drain assembly which is connected to a three inch elbow (14) and a drop (14A). The drop (14A) slides within a three to four inch or larger, or three to three inch modified expansion joint assembly (15) containing an O-ring (15A) and union cap (15B) to make the assembly gas tight.

The modified expansion joint (15) (SEE FIG. 5) has enough length provided to move the toilet vertically for the distance needed. Another double clamping arrangement (15C) approximately 1 foot apart may be added further down the pipe to increase stability.

Figure 6:
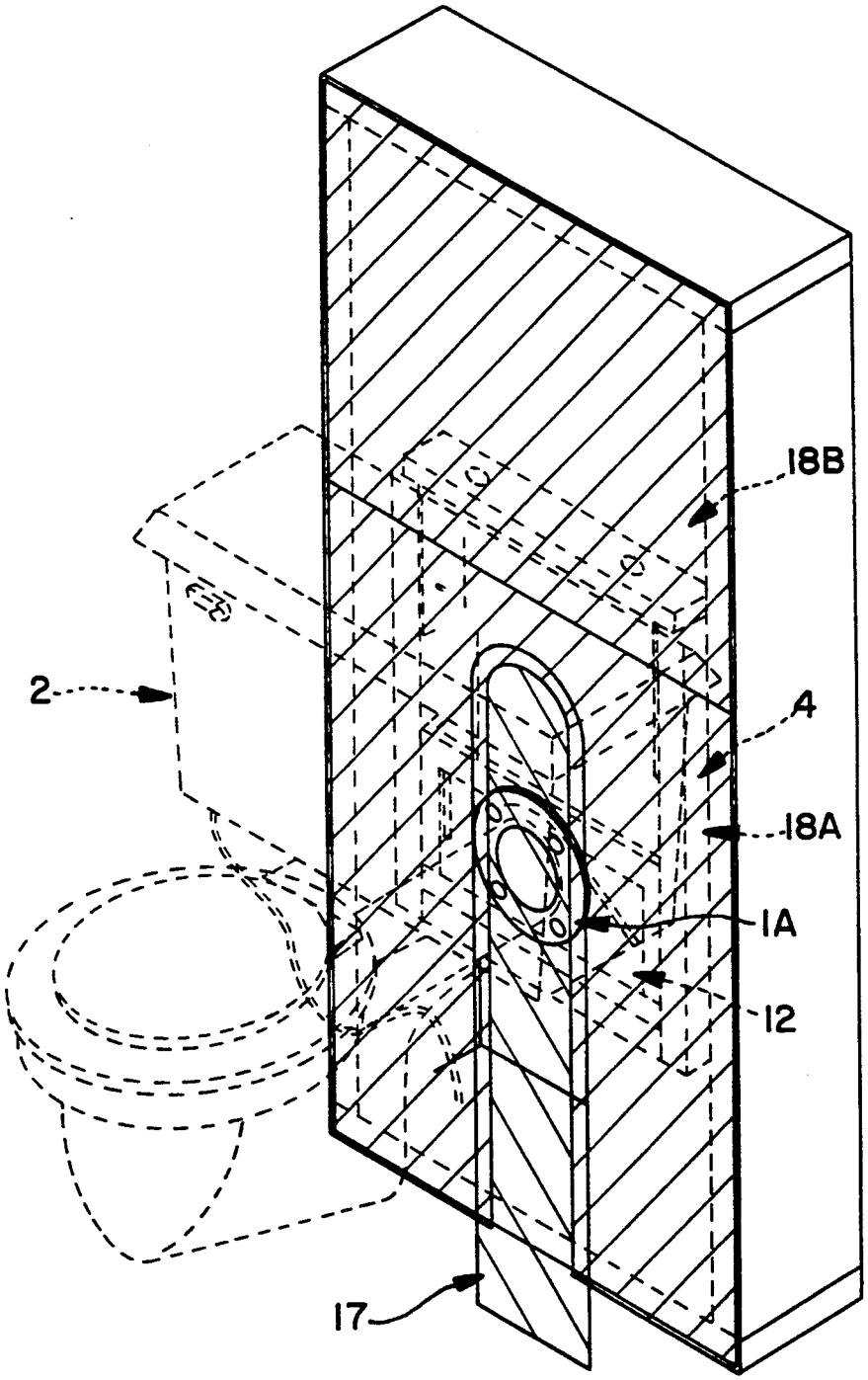
FIG. 6 shows the various safety features in the fachure board to prevent harm.

For safety reasons (eliminating pinch points), a tongue (17) is fixed to the inner assembly (4) (SEE FIG. 6). The mounting flange of the toilet hangs on the carrier (12) and slides within a slot in the bottom part of the facia board (18A). The removable upper part of the facia board (18B) allows easy service access. The upper (18B) and lower (18A) parts of the facia board defining facia board means (18) for concealing the elements mounted within the outer box. The tongue (17) is fixed around the flange of the toilet and secured to the carrier by four studs (1A). The studs hold the toilet to the carrier (12) as well as the tongue (17). Any pinch points that could arise are hidden by the tank (2).

The adjustable water closet (See FIG. 1) is activated electronically and remotely by the user or caregiver. Automatic settings can be stored and/or over-ridden in the control panel (20). The control panel (20) is attached to the motor (10) by a cable (20A). Power is intercepted by the downward and upward microswitches (3C and 3B respectively).

I claim:

1. Elevation adjusting apparatus for connection to a vertical wall for allowing elevation adjustment of a toilet, said apparatus comprising:

an outer box-shaped frame adapted to be mounted to the wall such that two opposing sides thereof are oriented substantially vertically, said sides having opposing channels mounted thereto interiorly of said outer frame;

an inner box-shaped frame having guide wheels mounted to two opposing sides thereof exteriorly of said inner frame, said wheels being engaged with said channels to allow substantially vertical displacement of said inner frame with respect to said outer frame;

a toilet carrier fixedly mounted to said inner frame, said carrier having a passage therethrough and being adapted to support the toilet with a discharge pipe thereof extending through said passage; and, a drive mechanism for effecting said vertical displacement of said inner frame, said mechanism including: a pair of spaced apart, substantially vertically oriented drive screws rotatably mounted above said inner frame to said outer frame and freely extending through apertures formed in a top side of said inner frame; a safety lifting block having a pair of threaded apertures engaged by lower end portions of said screws; a reversible motor mounted to said outer frame; and drive linkage operably connecting said motor and said screws, whereby said drive mechanism is normally operable to raise and lower the toilet with said inner frame supported on said safety lifting block, but upon interference with the toilet during lowering movement thereof, said safety lifting block will separate from said inner frame thereby preventing exertion of force on the toilet from said motor.

2. The apparatus as described in claim 1, further including three microswitches, a first microswitch being mounted to an upper portion of said outer frame to function as an upper limit switch, a second microswitch being mounted to a lower portion of said outer frame to function as a lower limit switch, and the third microswitch being mounted to said inner frame to function as a motor stop switch should interference with the toilet occur.

3. The apparatus as described in claim 1, further including facia board means for substantially concealing elements within said outer frame.

4. The apparatus as described in claim 3, further including a tongue for concealing an opening in said board means that accommodates movement of the toilet.

5. The apparatus as described in claim 1, further including a control panel that controls said motor and which can store predetermined height adjustments.

6. The apparatus as described in claim 1, further including the discharge line of the toilet, said discharge line being telescopic and having an O-ring seal.

* * * * *